US009775477B2

(12) United States Patent
Eriksson

(10) Patent No.: US 9,775,477 B2
(45) Date of Patent: Oct. 3, 2017

(54) CLEANING NOZZLE FOR A VACUUM CLEANER

(71) Applicant: Aktiebolaget Electrolux, Stockholm (SE)

(72) Inventor: Henrik Eriksson, Stockholm (SE)

(73) Assignee: Aktiebolaget Electrolux (SE)

( * ) Notice: Subject to any disclaimer, the term of this patent is extended or adjusted under 35 U.S.C. 154(b) by 0 days.

(21) Appl. No.: 14/888,275

(22) PCT Filed: May 2, 2013

(86) PCT No.: PCT/EP2013/059148
§ 371 (c)(1),
(2) Date: Oct. 30, 2015

(87) PCT Pub. No.: WO2014/177216
PCT Pub. Date: Nov. 6, 2014

(65) Prior Publication Data

US 2016/0073841 A1 Mar. 17, 2016

(51) Int. Cl.
*A47L 9/04* (2006.01)
*A47L 9/28* (2006.01)
*A47L 9/32* (2006.01)

(52) U.S. Cl.
CPC ..... *A47L 9/0466* (2013.01); *A47L 9/0411* (2013.01); *A47L 9/0477* (2013.01); *A47L 9/2873* (2013.01); *A47L 9/322* (2013.01)

(58) Field of Classification Search
CPC .... A47L 9/0466; A47L 9/0411; A47L 9/0477; A47L 9/2873; A47L 9/322
See application file for complete search history.

(56) References Cited

U.S. PATENT DOCUMENTS

| | | | |
|---|---|---|---|
| 804,213 | A | 11/1905 | Chaplin |
| 969,441 | A | 9/1910 | Backer |
| 1,231,077 | A | 6/1917 | Scheffler |
| 1,268,963 | A | 6/1918 | Gray |
| 1,412,420 | A | 4/1922 | Polansky |

(Continued)

FOREIGN PATENT DOCUMENTS

| | | |
|---|---|---|
| CA | 2466000 | 5/2003 |
| CN | 1457742 | 11/2003 |

(Continued)

OTHER PUBLICATIONS

Entire patent prosecution history of U.S. Appl. No. 12/405,761, filed Mar. 17, 2009, entitled, "Agitator With Cleaning Features," now U.S. Pat. No. 8,601,643, issued Dec. 10, 2013.

(Continued)

*Primary Examiner* — Dung Van Nguyen
(74) *Attorney, Agent, or Firm* — RatnerPrestia

(57) ABSTRACT

A vacuum cleaner nozzle having a rotatable member for picking up particles from a surface to be cleaned, and an external cleaning apparatus for removing articles entangled to the rotatable member. The nozzle includes a support surface provided on a radially projecting member of the rotatable member, and a cleaning member provided on the external cleaning apparatus. During rotation of the rotatable member, the cleaning member co-operates with the support surface to remove entangled articles from the rotatable member.

19 Claims, 11 Drawing Sheets

(56) References Cited

U.S. PATENT DOCUMENTS 1,757,461 A 5/1930 Losey
1,813,325 A 7/1931 Smith
1,820,350 A 8/1931 Dance
1,907,692 A 5/1933 White
1,965,614 A 7/1934 Sellers
1,999,696 A 4/1935 Kitto
2,032,345 A 3/1936 Cranon
2,625,698 A 1/1953 De Kadt
2,642,601 A 6/1953 Saffioti
2,642,617 A 6/1953 Lilly
2,663,045 A 12/1953 Conway
2,733,000 A 1/1956 Sparklin
2,741,785 A 4/1956 Siebert
2,789,306 A 4/1957 Kath
2,904,818 A 9/1959 Sheahan
2,960,714 A 11/1960 Senne
2,975,450 A 3/1961 Williams
3,268,936 A 8/1966 Fukuba
3,470,575 A * 10/1969 Gordon ..... A46B 17/06 15/188
3,536,977 A 10/1970 Porter
3,683,444 A 8/1972 Schaefer
3,722,018 A 3/1973 Fisher
3,862,467 A 1/1975 Krickovich
3,863,285 A 2/1975 Hukuba
3,928,884 A 12/1975 Sutter
4,020,526 A 5/1977 Johansson
4,084,283 A 4/1978 Rosendall
4,171,554 A 10/1979 Tschudy
4,173,054 A 11/1979 Ando
4,193,710 A 3/1980 Pietrowski
4,209,872 A 7/1980 Maier
4,317,253 A 3/1982 Gut
4,352,221 A 10/1982 Revells
4,370,690 A 1/1983 Baker
4,370,777 A 2/1983 Woerwag
4,372,004 A 2/1983 Vermillion
4,373,228 A 2/1983 Dyson
4,398,231 A 8/1983 Currence
4,426,751 A 1/1984 Nordeen
4,573,235 A 3/1986 Baird, Sr.
4,654,924 A 4/1987 Getz
4,702,122 A 10/1987 Richard
4,802,254 A 2/1989 Lahndorff
4,847,944 A 7/1989 Lackner
4,875,246 A 10/1989 MacGregor
4,920,605 A 5/1990 Takashima
4,953,253 A 9/1990 Fukuda
4,989,293 A 2/1991 Bashyam
5,075,922 A 12/1991 Tsuchida
5,115,538 A 5/1992 Cochran
5,121,592 A 6/1992 Jertson
5,203,047 A 4/1993 Lynn
5,243,732 A 9/1993 Koharagi
5,287,581 A 2/1994 Lo
5,394,588 A 3/1995 Kweon
5,452,490 A 9/1995 Brundula
5,482,562 A 1/1996 Abernathy
5,657,503 A 8/1997 Caruso
5,657,504 A 8/1997 Khoury
5,698,957 A 12/1997 Sowada
5,974,975 A 11/1999 Seefried
6,042,656 A 3/2000 Knutson
6,123,779 A 9/2000 Conrad
6,131,238 A 10/2000 Weber
6,170,119 B1 1/2001 Conrad
6,253,414 B1 7/2001 Bradd
6,266,838 B1 7/2001 Caruso
6,282,749 B1 9/2001 Tajima
6,286,180 B1 9/2001 Kasper
6,289,552 B1 9/2001 McCormick
6,351,872 B1 3/2002 McCormick
6,367,120 B2 4/2002 Beauchamp
6,502,277 B1 1/2003 Petersson
6,539,575 B1 4/2003 Cohen
6,539,577 B1 4/2003 Okuda
6,605,156 B1 8/2003 Clark
6,810,559 B2 11/2004 Mertes
6,883,201 B2 4/2005 Jones
6,892,420 B1 5/2005 Haan
7,143,461 B2 12/2006 Spooner
7,159,276 B2 1/2007 Omoto
7,163,568 B2 1/2007 Sepke
7,171,723 B2 2/2007 Kobayashi
7,228,593 B2 6/2007 Conrad
7,237,298 B2 7/2007 Reindle
7,243,393 B2 7/2007 Matusz
7,293,326 B2 11/2007 Hawkins
7,627,927 B2 12/2009 Blocker
7,631,392 B1 12/2009 Meitz
7,731,618 B2 6/2010 Burlington
8,087,117 B2 1/2012 Kapoor
8,418,303 B2 4/2013 Kapoor
8,567,009 B2 10/2013 Krebs
8,601,643 B2 12/2013 Eriksson
8,671,515 B2 3/2014 Eriksson
9,072,416 B2 7/2015 Kowalski
9,186,030 B2 * 11/2015 Jung ..... A47L 9/106
9,314,140 B2 4/2016 Eriksson
2002/0007528 A1 1/2002 Beauchamp
2004/0172769 A1 9/2004 Giddings
2004/0181888 A1 9/2004 Tawara
2004/0244140 A1 12/2004 Joo
2005/0015916 A1 1/2005 Orubor
2005/0015922 A1 1/2005 Lim
2005/0091788 A1 5/2005 Forsberg
2006/0000053 A1 1/2006 Lim
2006/0037170 A1 2/2006 Shimizu
2006/0162121 A1 7/2006 Naito
2006/0272122 A1 12/2006 Butler
2006/0288517 A1 12/2006 Oh
2007/0079474 A1 4/2007 Min
2008/0052846 A1 3/2008 Kapoor
2008/0289141 A1 11/2008 Oh
2009/0000057 A1 1/2009 Yoo
2009/0100636 A1 4/2009 Sohn
2009/0229075 A1 9/2009 Eriksson
2010/6107359 5/2010 Yoo
2010/0205768 A1 8/2010 Oh
2010/0287717 A1 11/2010 Jang
2010/0313912 A1 12/2010 Han
2011/0035900 A1 2/2011 Chae
2012/0013907 A1 1/2012 Jung
2012/0124769 A1 5/2012 Krebs
2013/0007982 A1 1/2013 Yun
2013/0008469 A1 1/2013 Yun
2013/0042429 A1 2/2013 Misumi
2013/0055522 A1 3/2013 Hawkins
2013/0192021 A1 8/2013 Eriksson
2013/0192022 A1 8/2013 Eriksson
2013/0192023 A1 8/2013 Eriksson
2013/0192024 A1 8/2013 Eriksson
2013/0198995 A1 8/2013 Eriksson
2014/0259521 A1 * 9/2014 Kowalski ..... A47L 9/0477 15/383
2014/0304941 A1 10/2014 Eriksson
2014/0331446 A1 11/2014 Eriksson
2014/0352104 A1 12/2014 Eriksson
2014/0359968 A1 12/2014 Eriksson
2014/0366300 A1 * 12/2014 Eriksson ..... A47L 9/00 15/246.2
2016/0015233 A1 1/2016 Uphoff

FOREIGN PATENT DOCUMENTS

CN 1593320 3/2005
CN 2746989 12/2005
CN 1816300 8/2006
CN 1816301 9/2006
CN 1883354 12/2006
CN 101310666 11/2008
CN 101686783 3/2010
CN 101984742 3/2011
CN 102334943 2/2012

(56) References Cited

FOREIGN PATENT DOCUMENTS

| | | |
|---|---|---|
| CN | 102462450 | 5/2012 |
| EP | 0649625 | 9/1994 |
| EP | 1415583 | 5/2004 |
| EP | 1442693 | 8/2004 |
| EP | 1642520 | 4/2006 |
| EP | 1994869 | 11/2008 |
| EP | 2253258 | 11/2010 |
| EP | 2273906 | 1/2011 |
| EP | 2543301 | 1/2013 |
| FR | 1068296 | 6/1954 |
| FR | 2855742 | 12/2004 |
| GB | 2000963 | 6/1978 |
| GB | 2231778 | 11/1990 |
| JP | 4944560 | 4/1974 |
| JP | 50114057 | 9/1975 |
| JP | 61062426 | 3/1986 |
| JP | 05095868 | 4/1993 |
| JP | 05103740 | 4/1993 |
| JP | 405095868 | 4/1993 |
| JP | 405305044 | 11/1993 |
| JP | 0686743 | 3/1994 |
| JP | 06086743 | 3/1994 |
| JP | 0856877 | 3/1996 |
| JP | 08056877 | 3/1996 |
| JP | 08289862 | 11/1996 |
| JP | 2002165731 | 6/2002 |
| JP | 2003047577 | 2/2003 |
| JP | 2003125991 | 5/2003 |
| JP | 2005160578 | 6/2005 |
| JP | 2005211426 | 8/2005 |
| JP | 2008000382 | 1/2008 |
| JP | 2008188319 | 8/2008 |
| JP | 2008278947 | 11/2008 |
| JP | 2009022644 A | 2/2009 |
| WO | 9210967 | 7/1992 |
| WO | 2008099583 | 8/2008 |
| WO | 2009117383 | 9/2009 |
| WO | 2010041184 | 4/2010 |
| WO | 2013060365 | 5/2013 |
| WO | 2013060879 | 5/2013 |
| WO | 2013060880 | 5/2013 |
| WO | 2013113395 | 8/2013 |
| WO | 2014094869 | 6/2014 |

OTHER PUBLICATIONS

Entire patent prosecution history of U.S. Appl. No. 13/826,400, filed Mar. 14, 2013, entitled, "Brushroll Cleaning Feature With Resilient Linkage to Regulate User-Applied Force," now U.S. Pat. No. 8,671,515, issued Mar. 18, 2014.
Entire patent prosecution history of U.S. Appl. No. 13/826,630, filed Mar. 14, 2013, entitled, "Brushroll Cleaning Feature With Spaced Brushes and Friction Surfaces to Prevent Contact."
Entire patent prosecution history of U.S. Appl. No. 13/826,855, filed, Mar. 14, 2013, entitled, "Brushroll Cleaning Feature With Overload Protection During Cleaning."
Entire patent prosecution history of U.S. Appl. No. 13/826,934, filed Mar. 14, 2013, entitled, "Automated Brushroll Cleaning."
Entire patent prosecution history of U.S. Appl. No. 13/835,691, filed Mar. 15, 2013, entitled, "Vacuum Cleaner Agitator Cleaner With Power Control."
Entire patent prosecution history of U.S. Appl. No. 13/838,035, filed Mar. 15, 2013, entitled, "Vacuum Cleaner Agitator Cleaner With Brushroll Lifting Mechanism."
Entire patent prosecution history of U.S. Appl. No. 14/354,449, filed Apr. 25, 2014, entitled, "Cleaning Nozzle for a Vacuum Cleaner."
Entire patent prosecution history of U.S. Appl. No. 14/354,460, filed Jun. 19, 2014, entitled, "Cleaning Nozzle for a Vacuum Cleaner."
Entire patent prosecution history of U.S. Appl. No. 14/354,466, filed Apr. 25, 2014, entitled, "Cleaning Nozzle for a Vacuum Cleaner."
Entire patent prosecution history of U.S. Appl. No. 14/374,119, filed Aug. 25, 2014, entitled, "Cleaning Arrangement for a Nozzle of a Vacuum Cleaner."
Entire patent prosecution history of U.S. Appl. No. 14/462,956, filed Aug. 19, 2014, entitled, "Vacuum Cleaner Brushroll Cleaner Configuration."
Entire patent prosecution history of U.S. Appl. No. 14/467,697, filed Aug. 25, 2014, entitled, "Actuator Mechanism for a Brushroll Cleaner."
International Search Report and Written Opinion for International Application No. PCT/IB2014/001050, mailed Oct. 28, 2014.
International Search Report and Written Opinion for International Application No. PCT/IB2014/001256, mailed Oct. 28, 2014.
International Search Report for International Application No. PCT/EP2012/076620 mailed Jul. 23, 2013.
International Search Report for PCT International Application No. PCT/EP2011/068743 dated Jun. 14, 2012.
International Search Report for PCT International Application No. PCT/EP2012/051773 dated Sep. 17, 2012.
International Search Report for PCT International Application No. PCT/EP2012/071318 dated Jan. 3, 2013.
International Search Report for PCT International Application No. PCT/EP2012/071319 dated Dec. 11, 2012.
Non-Final Office Action mailed Apr. 16, 2015 for U.S. Appl. No. 14/354,460.
Notice of Allowance mailed Apr. 24, 2015 for U.S. Appl. No. 13/838,035.
Office Action (with English translation)for Chinese Patent Application No. 200980110915.5 dated Feb. 4, 2013.
Search Report and Written Opinion for PCT International Application No. PCT/US2009/037348 dated May 14, 2009.
Supplemental European Search Report for International Application No. EP09721677 dated Oct. 30, 2012.
Entire patent prosecution history of U.S. Appl. No. 14/702,034, filed May 1, 2015, entitled, "Cleaning Nozzle for a Vacuum Cleaner."
Entire patent prosecution history of U.S. Appl. No. 14/651,059, filed Jun. 10, 2015, entitled, "Cleaning Arrangement for a Rotatable Member of a Vacuum Cleaner, Cleaner Nozzle, Vacuum Cleaner and Cleaning Unit."
Office Action mailed May 20, 2015 for U.S. Appl. No. 13/835,691.
Entire patent prosecution history of U.S. Appl. No. 14/730,833, filed Jun. 4, 2015, entitled, "Vacuum Cleaner Agitator Cleaner With Agitator Lifting Mechanism."
Notice of Allowance mailed Jun. 24, 2015 for U.S. Appl. No. 13/826,855.
Office Action mailed Jul. 7, 2015 for U.S. Appl. No. 13/826,934.
Chinese Office Action issued Jul. 1, 2015 for Chinese Application No. 201310485330.X, including English language translation.
Chinese Office Action issued Jul. 14, 2015 for Chinese Application No. 201310479507.5, including English language translation.
Chinese Office Action issued Jul. 3, 2015 for Chinese Application No. 201310485943.3, including English language translation.
International Preliminary Report on Patentability for International Application No. PCT/IB2014/001050 mailed Sep. 15, 2015.
Chinese Office Action issued Jun. 30, 2015 for Chinese Application No. 201310485447.8, including English language translation.
International Preliminary Report on Patentability for International Application No. PCT/IB2014/001256 mailed Sep. 15, 2015.
Notice of Allowance mailed Sep. 10, 2015 for U.S. Appl. No. 13/826,630.
Notice of Allowance mailed Dec. 23, 2015 for U.S. Appl. No. 14/354,460.
Notice of Allowance mailed Dec. 31, 2015 for U.S. Appl. No. 13/826,630.
Notice of Allowance mailed Dec. 15, 2015 for U.S. Appl. No. 13/835,691.
Final Office Action mailed Nov. 30, 2015 for U.S. Appl. No. 13/826,934.
Chinese Office Action dated Feb. 29, 2016 for Chinese Application No. 201310485330.X with translation. (pp. 1-9).
Non Final Office Action for U.S. Appl. No. 14/730,833, mailed May 19, 2016. (pp. 1-31).
Chinese Office Action dated Apr. 1, 2016 for Chinese Application No. 201280076273.3 with translation. (pp. 1-17).
Chinese Office Action for Chinese Application No. 201310485447.8, dated Feb. 14, 2015 with translation. (pp. 1-5).

(56) References Cited

OTHER PUBLICATIONS

Non Final Office Action for U.S. Appl. No. 14/354,449, mailed Aug. 11, 2016, 45 pages.
Japanese Office Action for Japanese Application No. 2014-537645, dated Jun. 14, 2016 with translation, 5 pages.
Japanese Office Action for Japanese Application No. 2014-555092, dated May 24, 2016 with translation, 5 pages.
International Search Report and Written Opinion for International Application No. PCT/IB2015/001873, dated Feb. 4, 2016.
Notice of Allowance mailed Feb. 11, 2016 for U.S. Appl. No. 13/826,934.
Japanese Office Action mailed Dec. 15, 2015 for Japanese Application No. 2014-555092 with translation.
Chinese Office Action dated Nov. 27, 2015 for Chinese Application No. 201280068532.8 with translation.
Japanese Office Action for Japanese Application No. 2015548227, dated Oct. 14, 2016, 5 pages.
Chinese Office Action for Application No. 201280058003.X, dated Oct. 9, 2016, 18 pages.
Notice of Allowance for U.S. Appl. No. 14/354,449, mailed Nov. 30, 2016, 10 pages.
Notice of Allowance for U.S. Appl. No. 14/730,833, mailed Dec. 2, 2016, 14 pages.
Non Final Office Action for U.S. Appl. No. 14/354,466, mailed Jan. 27, 2017, 44 pages.
Non Final Office Action for U.S. Appl. No. 14/467,697, mailed Feb. 13, 2017, 50 pages.
Non Final Office Action for U.S. Appl. No. 14/462,956, mailed Feb. 22, 2017, 44 pages.
International Preliminary Report on Patentability for International Application No. PCT/IB2015/001873, dated Feb. 28, 2017, 3 pages.
Final Office Action for U.S. Appl. No. 14/354,466, dated May 12, 2017, 13 pages.
Chinese Office Action for Application No. 201280058003.X, dated Apr. 6, 2017 with translation, 17 pages.
Notice of Allowance for U.S. Appl. No. 14/354,449, dated Aug. 11, 2017, 9 pages.
Notice of Allowance for U.S. Appl. No. 14/354,466, dated Aug. 1, 2017, 8 pages.
Notice of Allowance for U.S. Appl. No. No. 14/462,956, dated Jul. 19, 2017, 10 pages.
Notice of Allowance for U.S. Appl. No. 14/467,697, dated Jun. 30, 2017, 11 pages.
Non Final Office Action for U.S. Appl. No. 14/374,119, dated Jun. 27, 2017, 8 pages.
Non Final Office Action for U.S. Appl. No. 14/651,059, dated Jul. 17, 2017, 8 pages.
Korean Office Action for Korean Application No. 10-2014-7013892, dated Jun. 30, 2017 with translation, 16 pages.

* cited by examiner

CLEANING NOZZLE FOR A VACUUM CLEANER

This application is a U.S. National Phase application of PCT International Application No. PCT/EP2013/059148, filed May 5, 2013, which is incorporated by reference herein.

TECHNICAL FIELD

The present invention relates to a nozzle for a vacuum cleaner comprising a rotatable member and a cleaning arrangement for removing articles entangled to the rotatable member. The invention is intended for battery powered vacuum cleaners as well as mains-operated vacuum cleaners. The nozzle according to the present invention is further envisaged for robotic vacuum cleaners.

BACKGROUND OF THE INVENTION

In vacuum cleaning nozzles provided with a rotatable member, i.e. a rotatable brush roll, it is known that threads, lint, human or animal hairs or any other fibrous material tend to cling or wrap around adhere to the brush roll during operation of the vacuum cleaner. This may impair the functioning of the cleaning nozzle.

In WO2009/117383A2 it is disclosed a cleaning nozzle for a vacuum cleaner provided with a rotary brush having projecting friction surfaces and one or more cleaning members for removing debris that has been wrapped around the rotary brush. The cleaning members are positioned adjacent the rotary brush and are adapted to move between a resting position and a cleaning position, and are arranged to clean the rotary brush during rotation of the brush. Debris that has been collected on a rotary brush is often difficult to remove because it has wrapped tightly around the brush roll and intertwined the bristles. Therefore, a significant force is needed to be able to thread off the entangled threads by means of a cleaning member pressing against a friction member. Such a force may be applied manually by a user of the vacuum cleaner. The electrical vacuum cleaner or motor brush head need to be capable of providing the necessary power to obtain rotation of the brush roll when such force is applied.

A drawback with the disclosed design is that the brush roll rotates during a cleaning action and may cause wear on a surface on which the nozzle rests during the cleaning action, such as a carpet or a wooden floor.

SUMMARY OF THE INVENTION

An object of the present invention is to overcome the above mentioned drawback relating to potential wear of a surface on which the nozzle rests during a cleaning action.

This object is achieved according to a first aspect of the invention by a nozzle for a vacuum cleaner. The nozzle comprises a rotatable member for picking up particles from a surface to be cleaned. The rotatable member is arranged around a longitudinal axis. The nozzle further comprises a cleaning arrangement for removing articles entangled to the rotatable member. The cleaning arrangement comprises at least one support surface provided on at least one radially projecting member of the rotatable member, and at least one cleaning member. The rotatable member is movable between a first position in which the cleaning member is arranged at a distance from the support surface and a second position in the vicinity of the rotatable member in which the cleaning member, during rotation of the rotatable member, co-operates with at least one segment of the support surface to remove any entangled articles from the rotatable member.

By having the rotatable member move between the first and the second position in the nozzle when debris is to be picked up on a surface underlying the nozzle on the one hand, and when articles entangled to the rotatable member are to be removed by the cleaning member on the other, the rotatable member will advantageously not be in contact with the underlying surface when a cleaning action is to be performed. i.e. when the rotatable member is set into contact with the cleaning member to remove the entangled articles. This eliminates the risk of having the rotatable member cause wear on a surface on which the nozzle rests during the cleaning action, such as a carpet or a wooden floor.

By providing resilient contact for a cleaning action, the necessary power to obtain rotation of a rotatable member, such as a brush roll, is limited compared to earlier solutions. Thereby, proper cleaning function is ensured during cleaning action.

The object is achieved according to a second aspect of the invention by a vacuum cleaner provided with such a nozzle.

In an embodiment of the present invention, the cleaning member comprises a sheet member, preferably a resilient sheet member, capable of providing a resilient contact with at least one segment of the at least one support surface in the at least one cleaning position during rotation of the rotatable member. Advantageously, by providing resilient contact for a cleaning action, the necessary power to obtain rotation of a rotatable member, such as a brush roll, is limited compared to earlier solutions. Thereby, proper cleaning function is ensured during cleaning action.

In embodiments, the cleaning member comprises a longitudinal bar holding the sheet member, preferably a resilient sheet member. The longitudinal bar is arranged along a longitudinal axis of the rotatable member.

In embodiments, the sheet member, preferably a resilient sheet member, of the cleaning member in the at least one cleaning position meets a tangent of the at least one segment of the at least one support surface at an angle $\alpha$ which is in the range of 40°-90°. The angle is chosen to enable efficient cleaning but still enable rotational movement of the rotatable member of the nozzle to ensure proper cleaning function during cleaning operation.

In embodiments, the sheet member, preferably a resilient sheet member, has a thickness in the range of 0.2-0.8 mm.

In embodiments, the at least one radially projecting member is helically arranged along a longitudinal axis of the rotatable member. The helical arrangement ensures proper cleaning of the rotatable member during rotation while at the same time the cleaning interaction is performed within a limited support surface. Thereby, the impact on the rotational speed of the rotatable member is reduced and an effective cleaning action is performed while at the same time normal cleaning operation is maintained.

In embodiments, one single radially projecting member is helically arranged along a longitudinal axis of the rotatable member.

In embodiments, a plurality of radially projecting members is helically arranged along a longitudinal axis of the rotatable member.

In embodiments, the rotatable member is moved from the first position to the second position by applying a pressing force to a push button provided on the nozzle at a surface turned towards a user.

In embodiments, at least one of the lever arms is connected via a linking mechanism to the push button on the nozzle.

In embodiments, at least one protruding part is arranged on the nozzle at a surface turned towards the surface to be cleaned. When a cleaning action is performed, the protruding part prevents the nozzle from tilting due to the force applied on it.

In embodiments, the rotatable member comprises radial ribs arranged perpendicular to the longitudinal axis of the rotatable member.

In embodiments, the radial ribs extend from the rotatable member to the at least one projecting member creating multiple pockets along the rotatable member. The multiple pockets hinder entangled articles from wandering towards the middle segment of the rotatable member. Thereby, entangled articles are distributed along the length of the rotatable member. Even distribution of the entangled articles is advantageous because the layers of entanglement will be fewer. Fewer revolutions of the rotatable member will then be needed for proper cleaning. The total cleaning time is thereby reduced.

In embodiments, the at least one support surface comprises a plurality of segments. Each of the segments is arranged at an individual radius in relation to the longitudinal axis. By choosing proper radius of the segments, the sheet member of the cleaning member will be in resilient contact with a limited area of the support surface. Contact in a limited area such as a single point ensure efficient cleaning while still not disturbing normal cleaning operation.

In embodiments, the radius of the segments is gradually changed whereby the segments form a continuous support surface.

In embodiments, a plurality of support surfaces is arranged on a plurality of radially projecting members.

In embodiments, the nozzle further comprises a nozzle cover that at least partly is made of transparent material such that the rotatable member may be visible through the nozzle cover. Thereby, the user is able to see if there are a lot of entangled articles present requiring a cleaning action to be performed.

The object of the present invention is further attained in a third aspect of the present invention by a nozzle for a vacuum cleaner. The nozzle comprises a rotatable member for picking up particles from a surface to be cleaned. The rotatable member is arranged around a longitudinal axis and comprises at least one support surface provided on at least one radially projecting member of the rotatable member. The rotatable member is movable between a first position, in which it is arranged to pick up particles from a surface to be cleaned, and a second position in which an external cleaning member cooperates with at least one segment of the support surface to remove any entangled articles from the rotatable member, the rotatable member projecting further out from the nozzle when in the second position than when in the first position.

The object of the present invention is further attained in a fourth aspect of the present invention by a cleaning arrangement comprising a socket for receiving the vacuum cleaner nozzle of the third aspect of the invention and at least one cleaning member arranged in the socket for cooperating with the rotatable member to remove articles entangled to the rotatable member when in the second position.

Thus, the nozzle of the vacuum cleaner is positioned in the socket of the cleaning arrangement of the fourth aspect of the present invention, wherein the rotatable member embodied in the form of a brush roll arranged around a longitudinal axis of the nozzle and employed for picking up particles from a surface to be cleaned cooperates with a correspondingly longitudinally extending cleaning member of the socket when the rotatable member is in the second position and set to rotate by having a user operating the vacuum cleaner to start the rotation, or by having the rotation start automatically when the arrangement receives the vacuum cleaner. Hence, the cleaning member will cooperate with the rotating brush roll of the vacuum cleaner to remove articles such as threads, lint, human or animal hairs or any other fibrous material which wraps around or adheres to the brush roll. To this end, the cleaning member is arranged to be positioned on a small distance from, or even in contact with, the rotating brush roll when the articles are to be removed. Advantageously, the debris is removed from the brush roll without having the user going through the tedious and awkward process of removing it manually. Further advantageous is that the cleaning arrangement of the fourth aspect of the present invention is arranged externally from the nozzle and thus no longer contained in the nozzle itself.

In an embodiment of the present invention, the cleaning arrangement is arranged in a charging stand for charging the vacuum cleaner. Thus, the vacuum cleaner nozzle according to the third aspect of the present invention is positioned in the socket of the charging stand whereupon the brush roll is set to rotate to commence cleaning thereof while the battery of vacuum cleaner simultaneous is charged. This embodiment further has the advantage that the vacuum cleaner will have access to required operating power for rotating the brush roll when cleaning of the brush roll is to be undertaken.

In an alternative embodiment of the present invention, the cleaning arrangement of the third aspect of the present invention is arranged to be hand-held. By providing a hand-held and portable cleaning arrangement, a user can advantageously move the arrangement around his/her house and clean the vacuum cleaner brush roll without having to position the vacuum cleaner in its charging stand. Such cleaning arrangement could further be used with vacuum cleaners which are not battery-driven and hence do not have an associated charging stand.

In a further embodiment of the fourth aspect of the present invention, the cleaning member comprises a sheet member, preferably a resilient sheet member, capable of providing a resilient contact with the rotatable member of the vacuum cleaner nozzle when in the second position. Advantageously, by providing resilient contact for a cleaning action, the power required by the vacuum cleaner to obtain rotation of the rotatable member is less as compared to a rigid, non-resilient cleaning arrangement. A further advantage is that wear of the rotatable member caused by the cleaning member decreases.

Further features of, and advantages with, the present invention will become apparent when studying the appended claims and the following description. Disclosed features of example embodiments may be combined to create embodiments other than those described in the following as readily understood by one of ordinary skill in the art to which this invention belongs, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
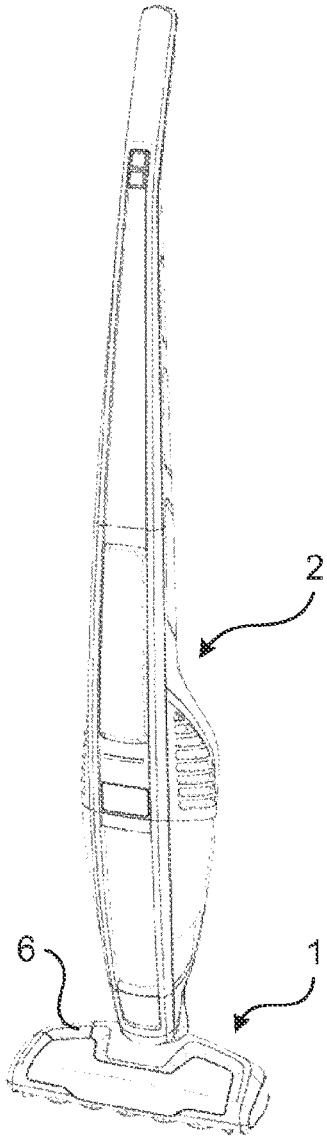
FIG. 1 illustrates a vacuum cleaner according to an embodiment.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates a vacuum cleaner 2 of an upright model comprising a nozzle 1 provided with a rotatable member (not shown), like a brush roll, for picking up particles from a surface to be cleaned. The nozzle 1 is further provided with a cleaning arrangement for removing articles entangled to the rotatable member. In an embodiment of the present invention, the nozzle 1 comprises a cover (not shown) that at least partly is made of transparent material such that the rotatable member may be visible through the nozzle cover. Thereby, the user is able to see if there are a lot of articles like hair entangled to the rotatable member. In a further embodiment of the present invention, the user initiates cleaning of the rotatable member 3 by pushing a push button 6 on the nozzle 1.

Figure 2:
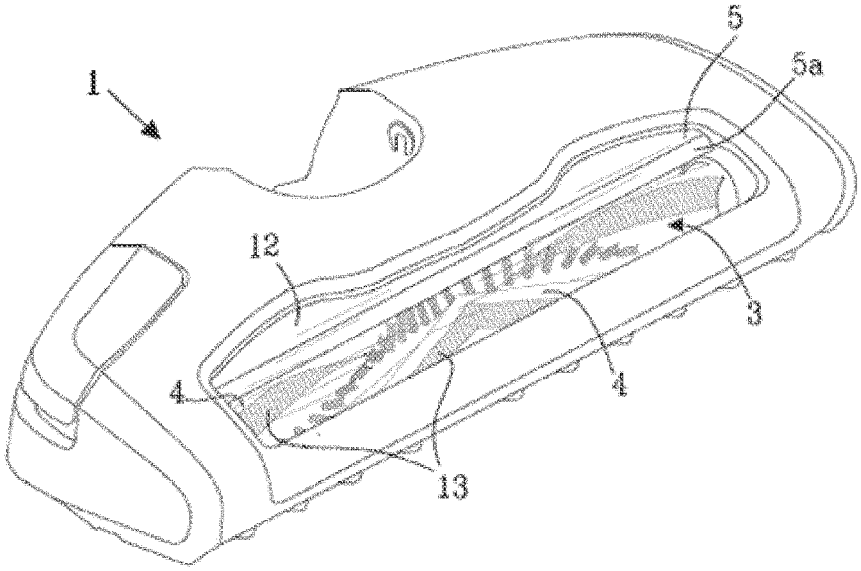
FIG. 2 illustrates a nozzle with a brush roll comprising a projecting cleaning surface in accordance with an embodiment in a top view.

FIG. 2 shows a nozzle 1 according to an embodiment more in detail. The cleaning arrangement comprises a cleaning member 5 and a support surface 4 provided on a radially projecting member 13 of the rotatable member 3. In the embodiment shown, two projecting members 13 are helically arranged along a longitudinal axis of the rotatable member 3. Other possible alternatives may be a single helically arranged projecting member 13, or more than two helically arranged projecting members 13. The cleaning member 5 is fixedly arranged in the nozzle 1 while the rotatable member 3 is movable between a first position in which the cleaning member 5 is arranged at a distance from the support surface 4 of the rotatable member 3, i.e. in a position where the rotatable member 3 cleans a surface under the nozzle 1, and a second position where the cleaning member 5 cooperates with the rotatable member 3 to remove articles entangled to the rotatable member 3. The movement between the positions may be arranged to occur stepwise or gradual, thus enabling the support surface 4 to approach the cleaning member 5 in a controlled manner during cleaning action. This might be advantageous for example if a thick layer of entangled articles are present, or if the power available for driving the rotatable member 3 is limited. In an embodiment, a push button 6, connected via a linking mechanism (to be described in more detail in the following) to the rotatable member 3, is provided to move the rotatable member 3 between the first position and the second position.

It should be noted that in an alternative embodiment, the cleaning member 5 is movably arranged in the nozzle 1 such that the cleaning member 5 can be moved towards the rotatable member 3 when a cleaning action is to be undertaken and then move back into the nozzle 1 when the cleaning of the rotatable member 3 has been performed.

In a further embodiment of the present invention, in the second position, a sheet member 5*a*, preferably a resilient sheet member, of the cleaning member 5 co-operates with the support surface 4 during rotation of the rotatable member 3 to remove any entangled articles from the rotatable member 3. The sheet member 5*a* is capable of providing a resilient contact with the support surface 4 in the cleaning position during rotation of the rotatable member 3. Thereby, the possible slow down of the rotational speed of the rotatable member 3 due to the cleaning action will be limited if there is a lot of entangled articles to be removed. As previously mentioned, the nozzle 1 may comprise a cover 12 that at least partly is made of transparent material such that the rotatable member 3 may be visible through the nozzle cover 12. The transparency enables a user to see if a cleaning action is needed or not for the rotatable member 3.

Figure 3:
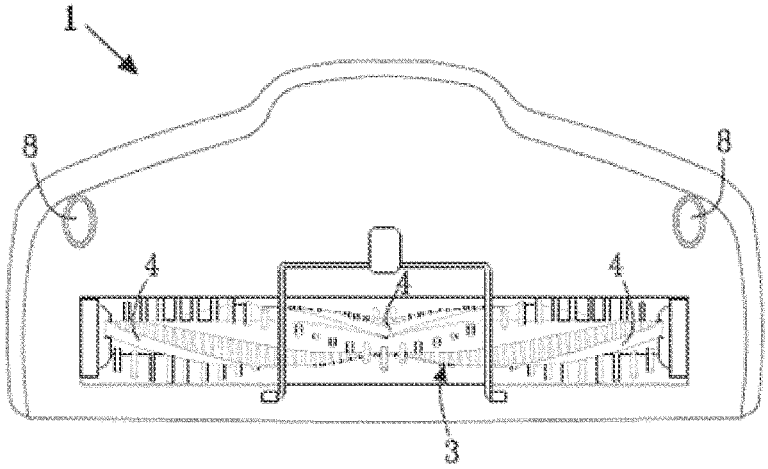
FIG. 3 illustrates the nozzle from underneath.

FIG. 3 illustrates the nozzle 1 from underneath. When the push button 6 is pressed down, the nozzle 1 is prevented from tilting by one or more protruding parts 8 provided underneath the nozzle 1 in an embodiment of the invention. The protruding part (-s) 8 is arranged on the nozzle 1 at a surface turned towards the surface to be cleaned.

As can be seen, the rotatable member 3 can be moved between the first position where the rotatable member 3 is not in contact with the cleaning member 5 but is lowered towards an underlying surface and thus is set in an debris extracting mode, and the second position where the rotatable member 3 is lifted up from the underlying surface and set into contact with the cleaning member and thus is in a cleaning mode.

Figure 4A:
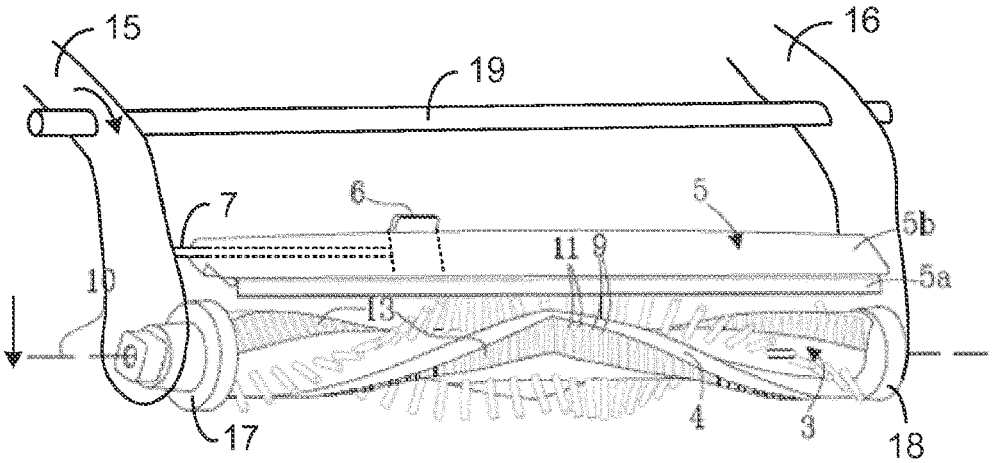
FIG. 4*a-d* illustrate a cleaning arrangement for the brush roll of the nozzle according to embodiments.
Figure 4B:
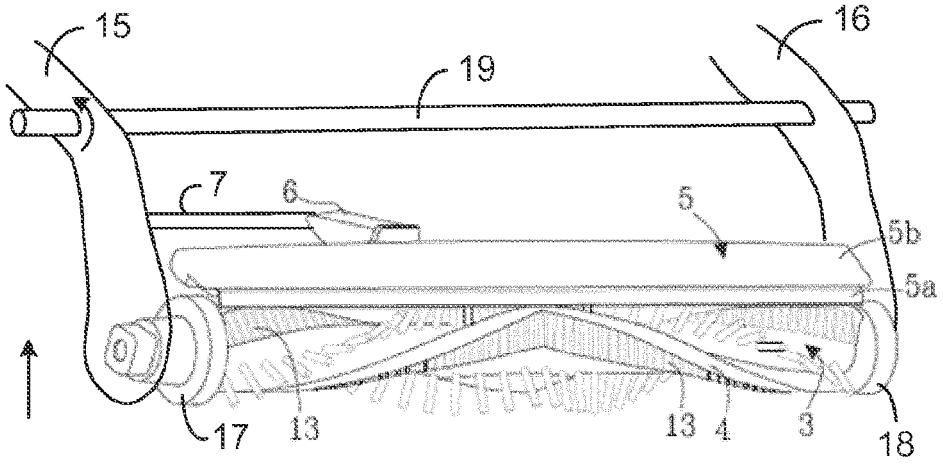

FIGS. 4*a-b* illustrates these two different modes of the cleaning arrangement for a brush roll of the nozzle according to an embodiment. The cleaning member 5 is arranged via a longitudinal bar 5*b* above the rotatable member 3 such that the rotatable member 3 is pivoted from the first position where it contacts the underlying floor for removing debris to a second position where the support surface 4 of the rotatable member 3 comes in contact with the cleaning member 5. The length of the cleaning member 5 is preferably the same as the length of the brush roll that is covered by the support surface 4. Two radially projecting members 13 are helically arranged along a longitudinal axis 10 of the rotatable member 3. The cleaning member 5 comprises a longitudinal bar 5*b* holding a sheet member 5*a*, preferably a resilient sheet member. The cleaning member 5 is arranged along a longitudinal axis 10 of the rotatable member 3. The sheet member 5*a* has preferably a thickness in the range of 0.2-0.8 mm. It is of importance to choose a suited material for the sheet member 5*a*. The material will, over time, get worn and loose its original tearing ability. To be wear resistant relatively hard spring steel may be used. The edge of the cleaning member 5 that will be in contact with the support surface need to be relatively sharp in order to effectively remove entangled articles. By shearing, or punch pressing the spring steel, one of the edges of the sheared surface will be rounded while the other will have an edge burr. By punch pressing the cleaning member 5 one edge of the cut surface will be sharper than the other. By shearing, or punch pressing, there will be as mentioned above, an edge burr at the cleaning member 5 edge. If the edge burr is minimized this will create a sharp edge suited for cleaning entangled articles from the brush roll. As an alternative to the above mentioned edge burr, the edge of the cleaning member 5 may be sharpened by machining. Thereby, improved tolerance of the sharp edge is achieved.

With further reference to FIGS. 4*a-b*, in an embodiment of the present invention, a force is applied to the one or both of a pair of lever arms 15, 16 to which a respective end 17, 18 of the rotatable member is attached, which lever arms 15, 16 are joined by a shaft 19 located on a distance from and extending parallel to the rotatable member 3, around which shaft 19 the lever arms 15, 16 are pivotable to move the rotatable member 3 up and down between the first and second position. As can be seen in FIG. 4*a*, a clockwise pivot of the lever arms 15, 16 around the shaft 19 will cause the rotatable member 3 to move away from the cleaning member 5 and into the first position while, as shown in FIG. 4*b*, a counter-clockwise pivot of the lever arms 15, 16 around the shaft 19 will cause the rotatable member 3 to move towards the cleaning member 5 and into the second position.

It should be noted that a number of different ways of applying the force to the lever arms 15, 16 to cause a pivotal movement around the shaft 19 can be envisaged. In an embodiment, a push button 6 (previously illustrated in FIGS. 1 and 2) and a linking mechanism 7 connected to one or both of the lever arms 15, 16 is used to move the rotatable member 3 between the first and the second position. Thus, the rotatable member 3 is moved from the second, cleaning position to the first, debris extracting position by applying a pressing force to a push button 6 provided on the nozzle 1 at a surface turned towards a user. The pressing force applied to the push button 6 will be transferred to the lever arm 15 via the linking mechanism 7, that could also provide a resilient transfer of the force, to have the pair of lever arms 15,16 pivot clockwise around the shaft 19 and thus move the rotatable member 3 in a downwards direction away from the cleaning member 5.

In a further embodiment, the nozzle 1 further comprises a locking mechanism arranged to retain the rotatable member 3 in the first position when being activated. This embodiment may be implemented by having the push button 6 enter a locking mode when pressed downwards to an end position, for instance by providing the push button with snap functionality. When pressing the push button 6 downwards a second time, the locking mode is inactivated and the push button 6 will snap out of the locking mode and move from its end position in an upwards direction. This may further require that the push button 6 is arranged to be appropriately spring-loaded to move in the upwards direction.

With reference to FIG. 4*b*, the rotatable member 3 is thus moved from the first, debris extracting position by again applying a pressing force to the push button 6 which will move in an upwards direction by means of the previously mentioned spring-loaded arrangement. This upwards directed force will be transferred to the lever arm 15 via the linking mechanism 7 to have the pair of lever arms 15,16 pivot counter-clockwise around the shaft 19 and thus move the rotatable member 3 in an upwards direction towards the cleaning member 5.

Figure 4C:
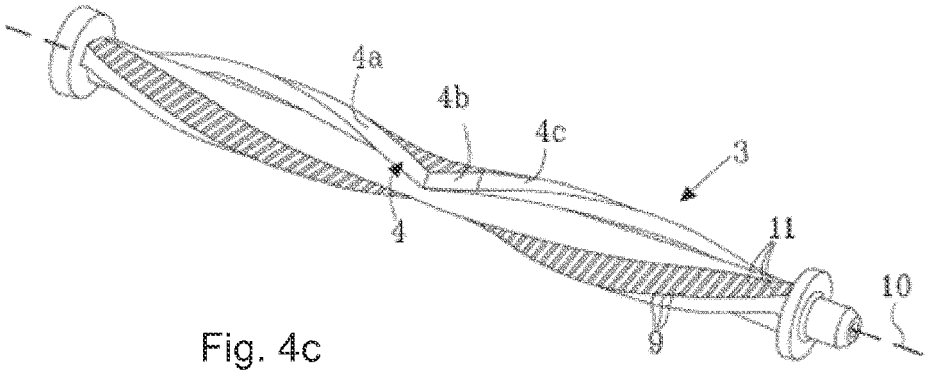

FIG. 4*c* illustrates a rotatable member 3 shown as a brush roll provided with a support surface 4 with a plurality of segments 4*a*, 4*b*, 4*c*. Each of the segments 4*a*, 4*b*, 4*c* are arranged at an individual radius in relation to the longitudinal axis 10. The radius of the segments is in the shown embodiment gradually changed whereby the segments form a continuous support surface 4. Alternatively, the radius may be changed in steps whereby three separate support surfaces with different radius are provided. The radius of the segment 4*a* is chosen to enable cleaning contact between the cleaning member and the surface segment 4*a*, when the rotatable member 3 is in the cleaning position. The radius of the segment 4*c* is chosen to enable a small distance between the cleaning member 5 and the segment 4*c*, when the rotatable member 3 is in the cleaning position. The segment 4*b* is provided with a gradually changing radius providing a smooth transition from the radius of segment 4*a* to the radius of segment 4*c*.

Figure 4D:
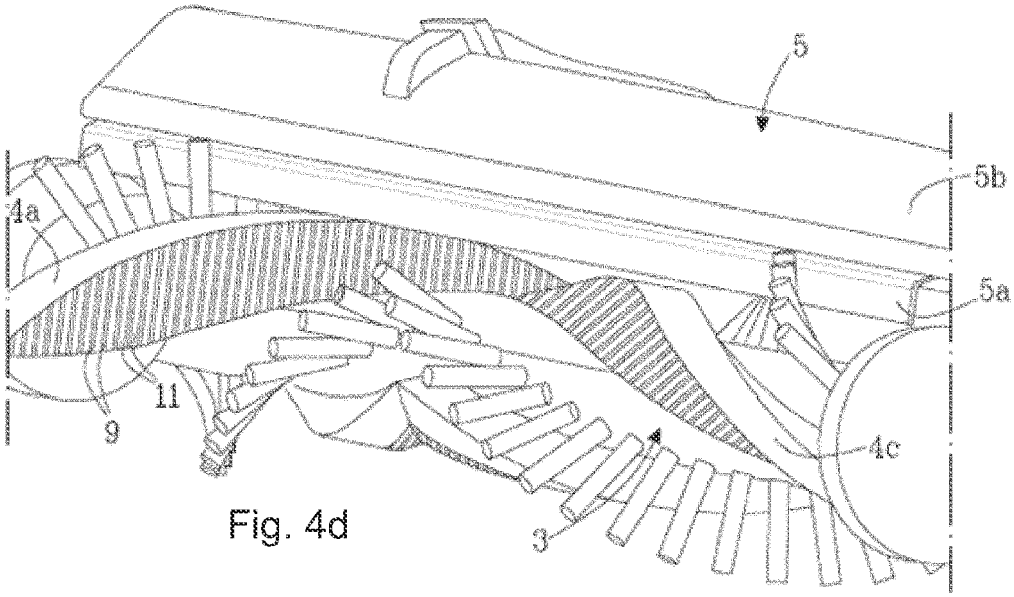

In FIG. 4*d* the cleaning member 5 is seen during cleaning of the rotatable member 3 of FIG. 4*c*. The sheet member 5*a*, preferably a resilient sheet member, of the cleaning member 5 will be in resilient contact with the support surface 4 in a single contact point at segment 4*a*. If the sheet member 5*a* is enabled to flex enough, a certain amount of contact may also be achieved at segment 4*c*. However, although some cleaning interaction may be performed at segment 4*c*, the majority of force applied to the rotatable member 3 will be transferred to segment 4*a*. By such an arrangement, at least the most part of the force applied to the rotatable member 3 is focused to the contact with segment 4*a*. Contact in a single point, or at least in a limited area, ensure efficient cleaning while still not disturbing the normal cleaning operation.

A problem during cleaning of the brush roll is that entanglement around the brush roll seems not to be evenly spread along the length of the brush roll. Instead, entanglement is of greatest magnitude in the middle segment of the brush roll. Such uneven distribution of the entangled articles is disadvantageous from a brush roll cleaning perspective because cleaning of the top layers of entanglement are performed for each revolution of the brush roll, i.e. the more the layers of entangled articles at a specific segment the longer the total cleaning time. Therefore, the brush roll cleaning time is dependent on the maximum layers of entanglement at one specific segment of the brush roll. Therefore it is more beneficial if the total entanglement is spread out along the length of the brush roll. As seen from the FIGS. 4*a-d*, the rotatable member 3 comprises radial ribs 9 arranged perpendicular to the longitudinal axis 10 of the rotatable member 3. The radial ribs 9 extend from the rotatable member 3 to the projecting member creating multiple pockets 11 along the rotatable member 3. The multiple pockets 11 hinder entangled hairs etc. from wandering towards the middle segment. Thereby, a greater distribution of the entangled articles along the length of the brush roll is achieved, and the total brush roll cleaning time is reduced. Each pocket 11 catches and hinder particles like hair from wandering along the length of the brush roll.

Figure 5A:
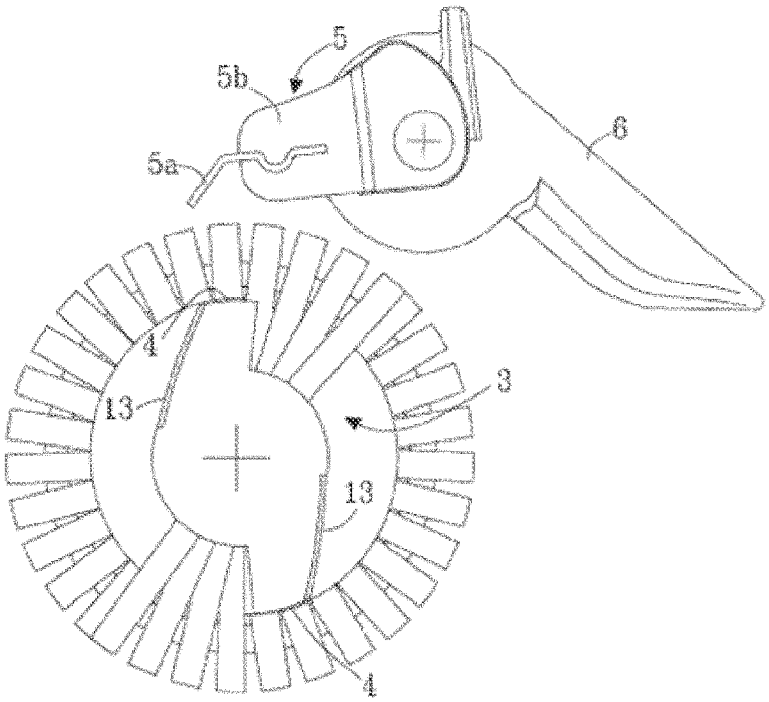
FIGS. 5*a* and 5*b* show a side view of the cleaning arrangement and the brush roll according to an embodiment.
Figure 5B:
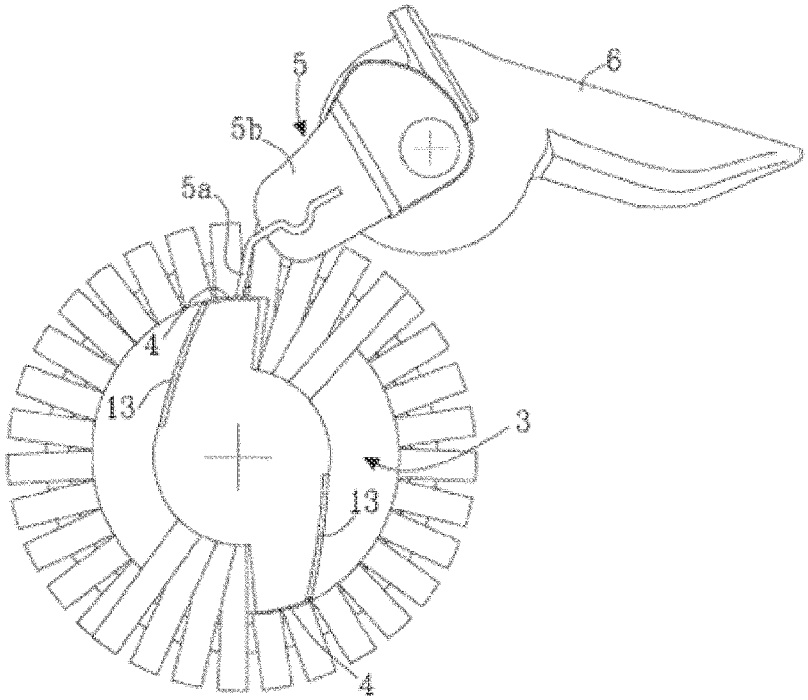

FIGS. 5*a* and 5*b* show a detailed side view of the cleaning arrangement and the brush roll according to an embodiment. In FIG. 5*a*, the rotatable member 3 is shown in the first, debris extracting position. There is no contact between the sheet member 5*a* and any parts of the rotating brush roll. In FIG. 5*b*, the cleaning member 5 is brought into a cleaning position such that the sheet member 5*a* contacts the support surface 4 of the rotating member 3 while the rotating member 3 has been pivoted into a cleaning position. The rotating brush roll 3 is brought in the near vicinity of the sheet member 5*a*, preferably a resilient sheet member, and a resilient contact is obtained between the sheet member 5*a* and the support surface 4. The sharp edge of the sheet member 5*a* will remove any articles entangled to the brush roll. Thus, in this particular embodiment, in addition to moving the rotating member 3 between its first and second position, the cleaning member 5 of the nozzle is moved between a cleaning position and a resting position to remove entangled articles. This will enable the cleaning member 5 to apply a higher pressure onto the support surface 4 to cause tearing friction for removing the entangled articles.

Figure 6A:
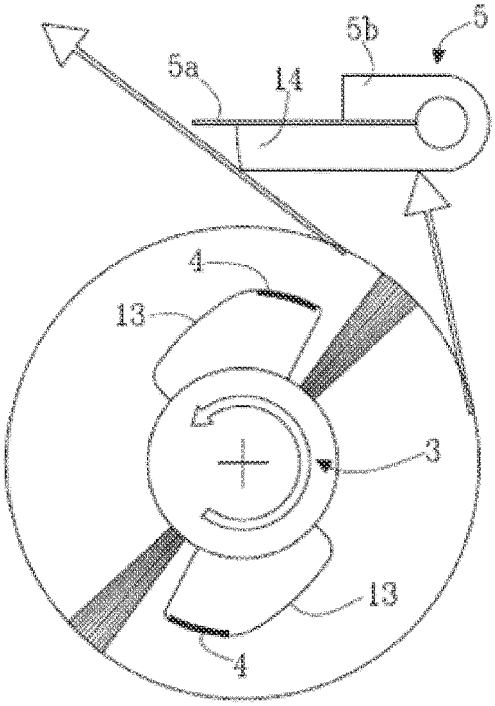
FIGS. 6*a* and 6*b* illustrate alternative arrangements in order to protect the cleaning arrangement and the brush roll with bristles from unnecessary wear when the cleaning arrangement is in a resting mode.
Figure 6B:
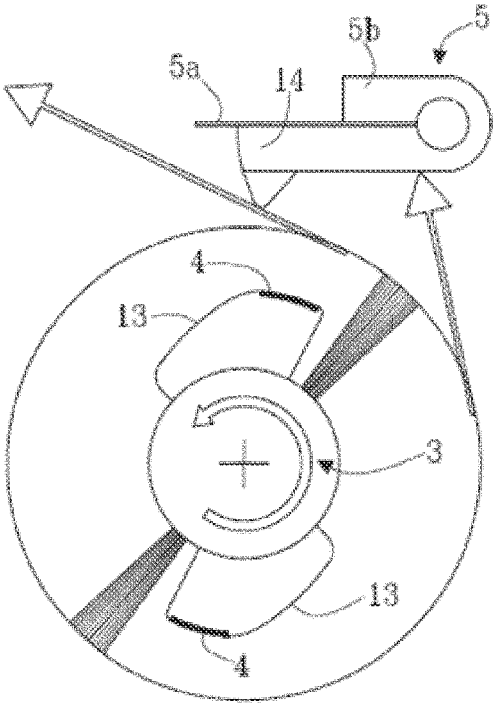

FIGS. 6*a* and 6*b* illustrate alternative arrangements in order to protect the brush roll from unnecessary wear when in the debris extracting mode. The cleaning member 5 is designed to be protected from wear during normal vacuum cleaning, and also to help in minimizing the wear of the bristles during brush roll cleaning. Hard particles like small stones or the like cleaned up by the rotatable member 3 may contribute to wear of the cleaning member 5, and especially of the sharp edge. As seen in the drawings particles are prevented from contact with the cleaning member 5 by a flange 14 arranged to face the rotatable member 3. Further, the flange 14 delimits wear of bristles on the brush roll due to contact between the bristles and the edge of the cleaning member 5. The bristles will first be in contact with the flange 14. Thereby, the bristles are bent before they get in contact with the edge and wear of the bristles are limited.

Figure 7:
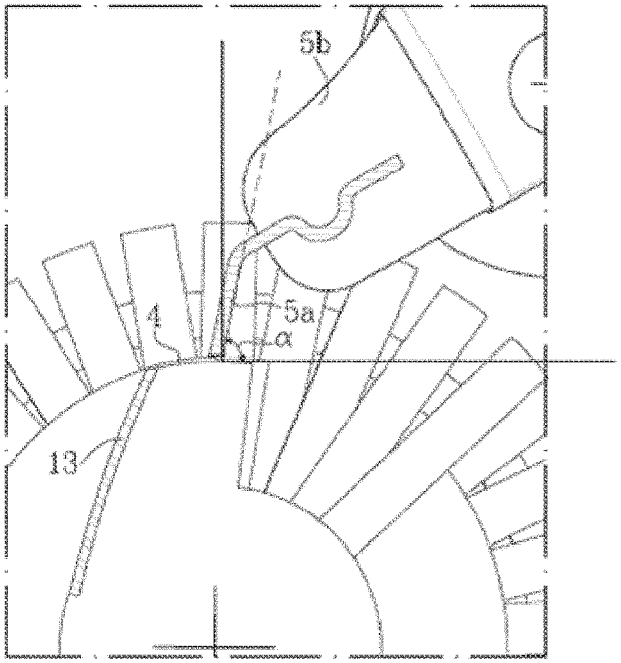
FIG. 7 shows details of the cleaning arrangement according to an embodiment.

FIG. 7 shows details of the cleaning arrangement according to an embodiment. The sheet member 5*a*, preferably a resilient sheet member, of the cleaning member 5 when the rotatable member 3 is positioned in the cleaning position meets a tangent of a segment of the support surface 4 at an angle $\alpha$ which is in the range of 40°-90°.

When in use, the cleaning arrangement works as follows. During brush roll cleaning the support surface 4 provided on the rotatable brush roll will interact and apply pressure on the cleaning member 5 provided in the nozzle 1 of a vacuum cleaner. During the cleaning process, the motor fan of the vacuum cleaner is also turned on. The support surface 4 is the only area of the brush roll, apart from the bristles, that will be in contact with the cleaning member 5 during a cleaning process. For a full revolution of the brush roll, the entire support surface 4 will have been in contact with the cleaning member 5 and therefore will any entangled article be exposed to the cleaning interaction in between these parts. Entangled articles will get torn into smaller pieces by the tearing, or friction, caused by the cleaning member 5 at the support surface. These torn articles may be separated from the brush roll by the airflow of the vacuum cleaner in combination with centrifugal force due to the rotational movement of the brush roll and will end up in the dust container or dust bag of the vacuum cleaner. The bristles of the brush roll will flex below the cleaning member 5 during brush roll cleaning. Since it is the pressure that the surface of the support surface 4 applies on the cleaning member 5 that generates the majority of the tearing friction, the bristles will not be exposed to the same wear as the entangled articles. Further, since the sheet member 5*a*, preferably a resilient sheet member, is able to flex, a consistent interaction in between the sheet member 5*a* and the support surface 4 during brush roll cleaning is achieved, which in turn will lower the tolerances. The brush roll cleaning performance is dependent on the rotational speed of the brush roll; the higher speed, the faster brush roll cleaning. Further on the speed is closely related to the torque; an increased torque will decrease the speed. It is therefore desirable to find a state were the applied torque is high enough for efficient brush roll cleaning whilst at the same time low enough to not decrease the speed too much.

Figure 8:
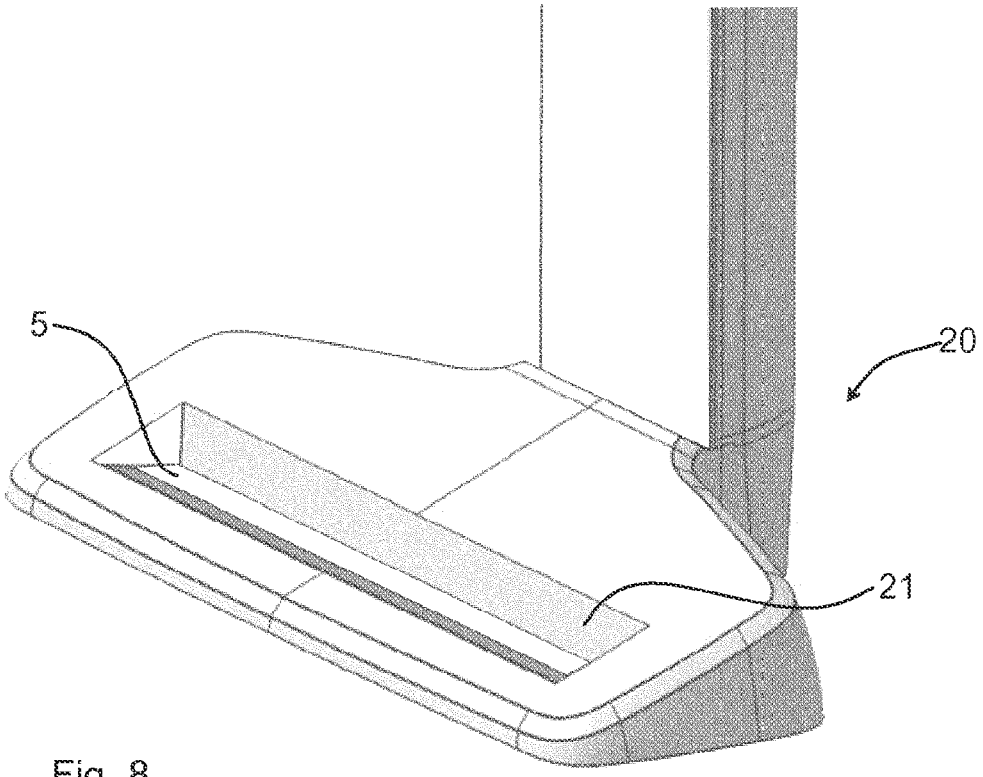
FIG. 8 shows an embodiment of a cleaning arrangement implemented in a charging stand according to an embodiment of the fourth aspect of the present invention.

FIG. 8 shows an embodiment of the cleaning arrangement according to the third aspect of the present invention where the cleaning arrangement is implemented in a charging stand 20 for charging a battery-driven vacuum cleaner as shown in FIG. 1. However, is should be noted that that the cleaning arrangement can be embodied in other forms, such as e.g. a portable arrangement which advantageously can be used with vacuum cleaners which are not battery-driven but connected to the mains. The cleaning arrangement comprises a socket 21 for receiving the vacuum cleaner nozzle (not shown in FIG. 9) and a cleaning member 5 arranged in the socket for removing articles entangled to a rotatable member of the vacuum cleaner nozzle during rotation of the rotatable member.

Figure 9A:
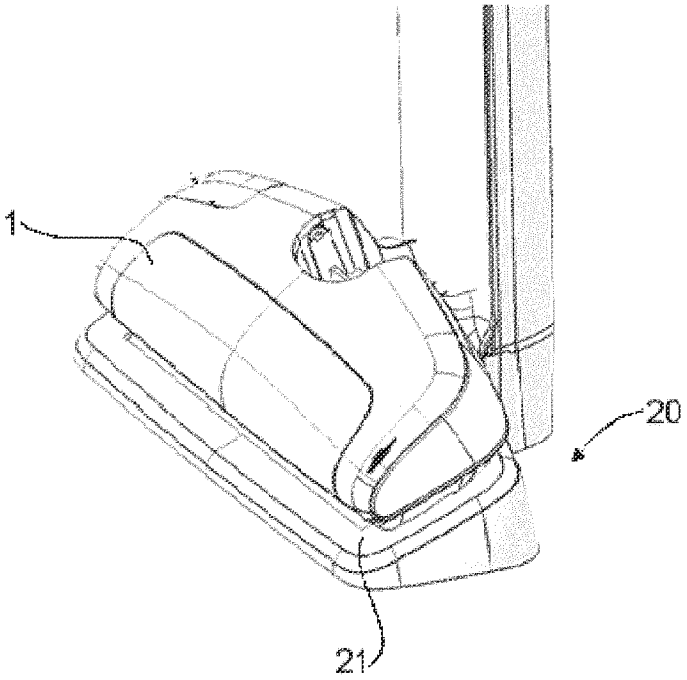
FIG. 9*a* shows a vacuum cleaner nozzle positioned in a cleaning arrangement according to an embodiment of the fourth aspect of the present invention.
Figure 9B:
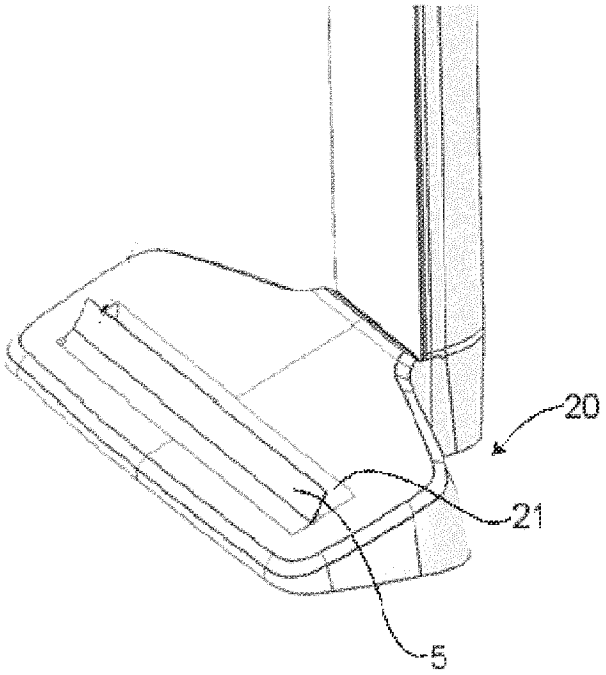
FIG. 9*b* shows the cleaning arrangement of FIG. 9*a* without having a nozzle positioned therein, wherein the cleaning member is in its cleaning position.

With reference to FIG. 9*a*, the nozzle 1 of the vacuum cleaner (not shown in FIG. 9*a*) according to the third aspect of the present invention is positioned in the socket 21 of the charging stand 20. The nozzle 1 is in its interior arranged with a rotatable member (as has been discussed in detail with reference to embodiments according to the previous aspects of the present invention) employed for picking up particles from a surface to be cleaned, which member is arranged along a longitudinal axis of the nozzle. FIG. 9*b* shows the cleaning member 5 of the cleaning arrangement arranged in the charging stand 20 (without the nozzle), which cleaning member 5 cooperates with the rotatable member 3 when the rotatable member is placed in the second position where the rotatable member 3 projects further out from the nozzle 1 than when in the first position where debris is picked up from the underlying surface, and is set to rotate, either automatically when the vacuum cleaner is set into contact with the cleaning arrangement or by having a user operating the vacuum cleaner to start the rotation. Hence, the cleaning member 5 will cooperate with the rotatable member 3, i.e. the brush roll of the vacuum cleaner, to remove articles such as threads, lint, human or animal hairs or any other fibrous material which wraps around or adheres thereto. FIG. 9*b* shows the cleaning member 5 in its cleaning position. Hence, the cleaning member is raised from the socket 21 to cooperate with the brush roll. While FIG. 8 shows the cleaning member 5 in its lowered, resting position, it is to be noted that a cleaning arrangement can be envisaged where the cleaning member always is in its raised position and thus cannot be selectively switched between a cleaning position and a resting position.

The nozzle 1 according to the third aspect of the invention works in a similar manner as that of the first aspect of the invention discussed e.g. with reference to FIGS. 4*a* and *b*. As has been discussed, the rotatable member 3 according to the first aspect of the present invention moves between a first position in which the cleaning member 5 is arranged at a distance from the support surface 4 of the rotatable member 3 and a second position in the vicinity of the cleaning member 5 in which the cleaning member 5, during rotation of the rotatable member 3, co-operates with the segment 4*a* of the support surface 4 to remove any entangled articles from the rotatable member 3.

The difference in movement of the rotatable member 3 of the first aspect of the present as compared to the third aspect of the invention is that the rotatable member 3 according to the third aspect of the invention moves between a first position in which it is arranged to pick up particles from a surface to be cleaned, and a second position in which a cleaning member 5 (for instance the cleaning member arranged in the socket 21 of the charging stand 20 of FIG. 8) cooperates with the segment 4*a* of the support surface 4 to remove any entangled articles from the rotatable member 3, wherein the rotatable member 3 projects further out from the nozzle 1 when in the second position than when in the first position (which is not the case in the first aspect).

However, the rotatable member 3 of the third aspect of the present invention can be moved between the first and second position in the manner shown in FIGS. 4*a* and *b*, i.e. by means of a push button 6 and a linking mechanism connected to at least one of a pair of lever arms 15.

Figure 10:
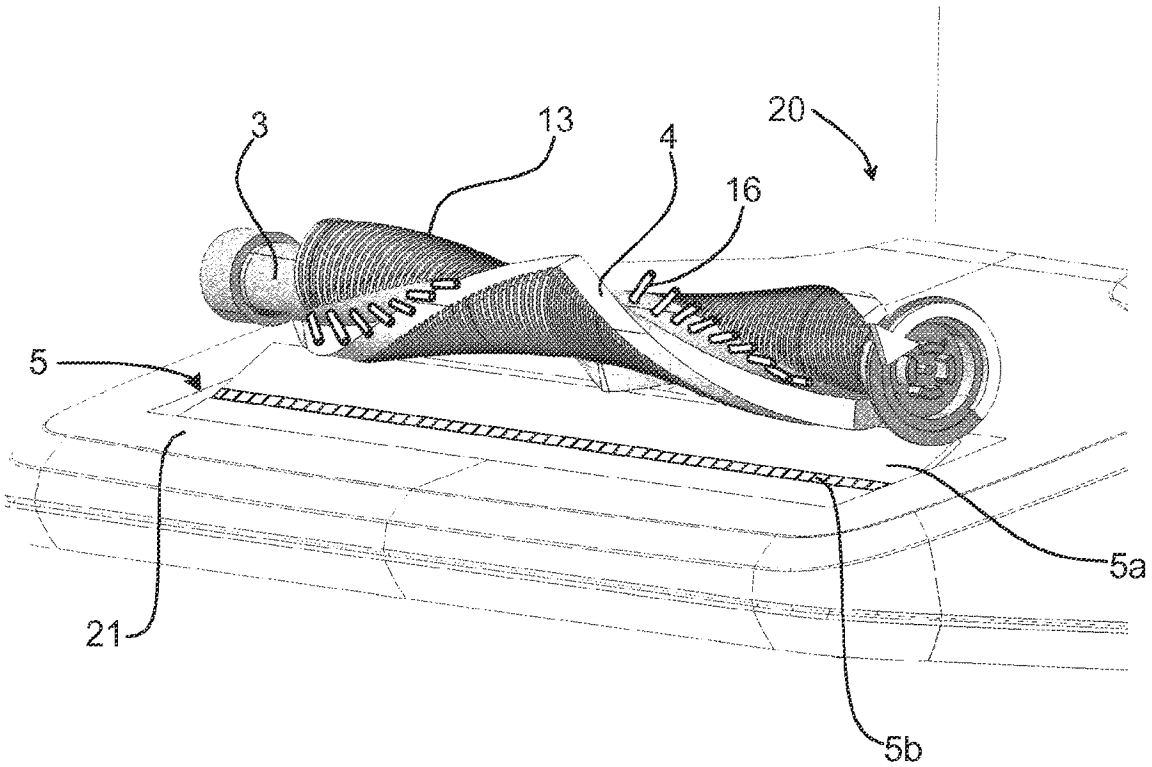
FIG. 10 shows a rotatable member positioned in a cleaning arrangement according to an embodiment of the fourth aspect of the present invention.

FIG. 10 shows a rotatable member 3 according to the third aspect being set in the second position and positioned in the socket 21 of the charging stand 1 for cleaning according to the fourth aspect of the present invention. The rotatable member 3 comprises a support surface 4 provided on a radially projecting member 13, as previously has been discussed with reference to other embodiments of the present invention. In the example shown, two projecting members 13 are helically arranged along a longitudinal axis of the rotatable member 3. In its cleaning position, the cleaning member 5 is raised from the socket 21 and set to contact the support surface 4 of the rotatable member 3. Upon rotation of the rotatable member 3, the cleaning member 5 will remove the articles adhered to the rotatable member 3. The cleaning member may be of a rigid material, but comprises in an embodiment of the present invention a sheet member 5*a*, preferably a resilient sheet member, capable of providing a resilient contact with the support surface 4 of the rotatable member 3. In a further embodiment, the cleaning member 5 comprises a longitudinal bar 5*b* holding the sheet member 5*a* in order to lend stability to the sheet member, thus increasing stability of the cleaning member.

It should be noted that there are several alternatives for raising the cleaning member 5 from the socket 21; for instance, in an embodiment, the cleaning arrangement may comprise a pivot mechanism (not shown) to pivotally move the cleaning member 5 to its cleaning position when the weight of the vacuum cleaner acts on the pivot mechanism. Thus, the vacuum cleaner is positioned in the socket 21 of the cleaning arrangement whereby the cleaning member 5 is raised into the cleaning position, making the complete procedure of setting the cleaning member in its cleaning position automatic from the perspective of the user. Thereafter, the brush roll 3 is set into rotating motion, either automatically or by user operation of the vacuum cleaner. In an alternative, the cleaning member 5 is arranged to be moved from the resting position to the cleaning position by applying a pressing force to a push button (not shown) provided on the socket 21, which force subsequently will act on the pivot mechanism to pivotally move the cleaning member 5 to its cleaning position.

When in use, the cleaning arrangement works as follows. During brush roll cleaning the cleaning member 5 will interact and apply pressure on the support surface 4 provided on the rotatable brush roll 3 of the vacuum cleaner nozzle. During the cleaning process, the motor fan of the vacuum cleaner is also turned on. For the brush roll 3 of FIG. 4, the support surface 4 is the only area of the brush roll that will be in contact with the cleaning member 5 during a cleaning process. For a full revolution of the brush roll 3, the entire support surface 4 will have been in contact with the cleaning member 5 and therefore any entangled article will be exposed to the cleaning interaction in-between these parts. Entangled articles will get torn into smaller pieces by the tearing, or friction, caused by the cleaning member 5 at the support surface 4. These torn articles may be separated from the brush roll 3 by the airflow of the vacuum cleaner in combination with centrifugal force due to the rotational movement of the brush roll 3 and will end up in the dust container or dust bag of the vacuum cleaner. The brush roll cleaning performance is dependent on the rotational speed of the brush roll; the higher speed, the faster brush roll cleaning. It should be noted that the bristles 16 of the brush roll 3 will be in contact with the cleaning member 5 during brush roll cleaning, but will bend such that they do not end up between the cleaning member 5 and the support surface 4. Thus, the bristles 16 are not subject to the degree of wear that e.g. hair entangled to the rotating brush roll 3 is.

Figure 11A:
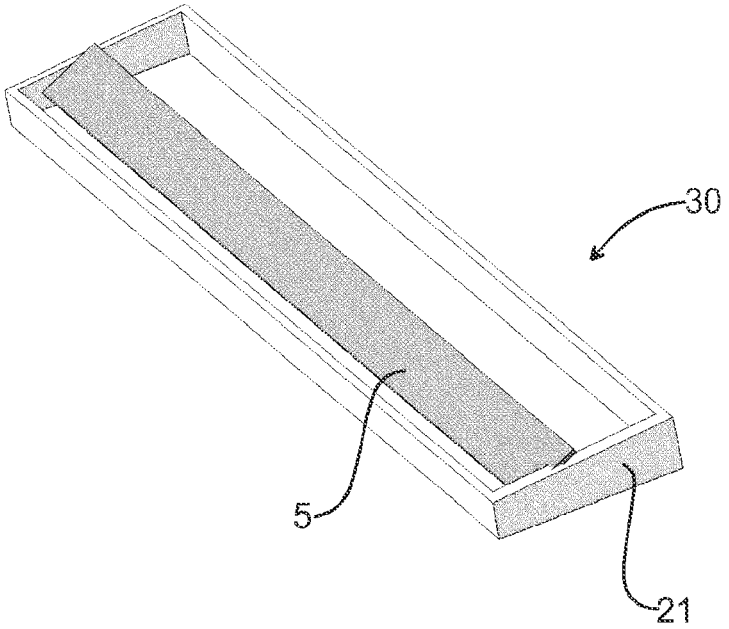
FIG. 11*a* shows a portable cleaning arrangement according to an embodiment of the fourth aspect of the present invention.
Figure 11B:
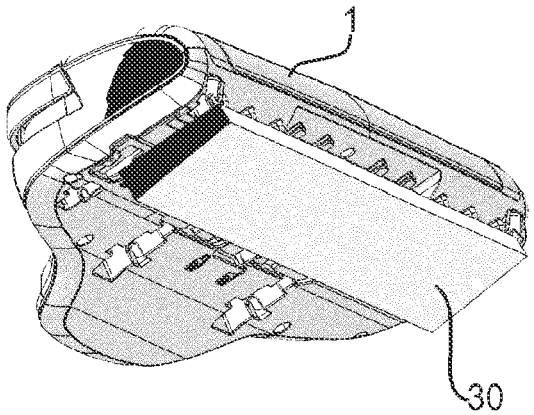
FIG. 11*b* shows the portable cleaning arrangement of FIG. 11*a* applied to a nozzle.
Figure 12:
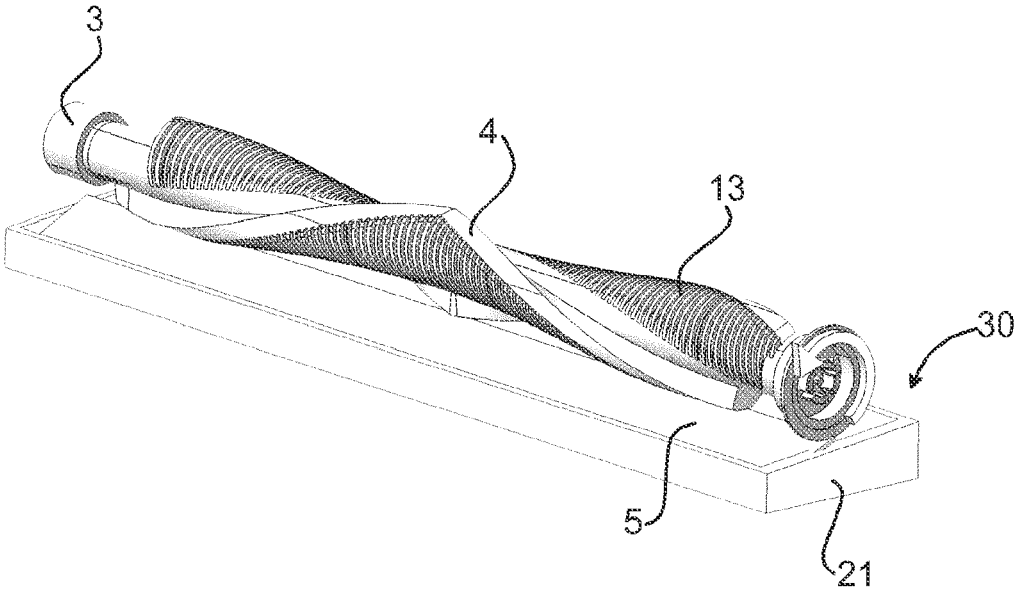
FIG. 12 shows the portable cleaning arrangement of FIG. 11*a* applied to a brush roll.

FIGS. 11*a* and *b* shows an alternative embodiment according to the fourth aspect of the present invention, where the cleaning arrangement 30 is arranged to be hand-held. By providing a hand-held and portable cleaning arrangement, a user can advantageously move the arrangement around his/her house and clean the vacuum cleaner brush roll without having to position the vacuum cleaner in its charging stand. Such cleaning arrangement could further be used with vacuum cleaners which are not battery-driven and hence do not have an associated charging stand. With reference to FIG. 11*a*, the portable cleaning arrangement 30 comprises in its simplest form a socket 21 with a cleaning member 5 arranged therein. With reference to FIG. 11*b*, the cleaning arrangement 30 is applied to the nozzle of the vacuum cleaner, and in the more detailed illustration shown in FIG. 12, it can be seen that the cleaning member 5 of the portable cleaning arrangement 30 is set into contact with the support surface 4 of the projecting member 13 of the brush roll 3 (shown without brushes) and cleaning of the nozzle brush roll can commence as has been described hereinabove. As previously mentioned, the cleaning member 5 can be arranged to be raised from the socket 21 to cooperate with the brush roll 3. Alternatively, the cleaning member 5 is fixedly arranged in the raised position.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A vacuum cleaner system comprising:

a vacuum cleaner nozzle comprising:

a nozzle body having a bottom surface;

a rotary brush mounted to the nozzle body to rotate about a longitudinal axis, the rotary brush having one or more bristles configured to extend below the bottom surface of the nozzle body for picking up particles from a surface to be cleaned, at least one radially projecting member extending radially from the longitudinal axis, and at least one support surface provided on the at least one radially projecting member;

an external cleaning apparatus, provided separately from the vacuum cleaner nozzle and comprising a cleaning member, the external cleaning apparatus being configured to be placed in an operative position adjacent the bottom surface of the nozzle body such that the cleaning member cooperates with the at least one support surface while the rotary brush rotates to remove debris from the rotary brush wherein the rotary brush is movable between a first position in which the rotary brush is arranged to pick up particles from the surface to be cleaned, and a second position when the external cleaning apparatus is in the operative position adjacent the bottom surface of the nozzle body, wherein the rotary brush projects further out from the bottom surface of the nozzle body when in the second position than when in the first position.

2. The vacuum cleaner system of claim 1, wherein the external cleaning apparatus comprises a socket configured to receive at least a portion of the vacuum cleaner nozzle, and the cleaning member is located in the socket.

3. The vacuum cleaner system of claim 2, wherein the cleaning member is movably mounted to the remainder of the external cleaning apparatus, between a resting position in which the cleaning member is not positioned to cooperate with the at least one support surface, and a raised position in which the cleaning member is positioned to cooperate with the at least one support surface while the rotary brush rotates to remove debris from the rotary brush.

4. The vacuum cleaner system of claim 3, wherein the cleaning member is pivotally mounted to the remainder of the external cleaning apparatus.

5. The vacuum cleaner system of claim 1, wherein the cleaning member is movably mounted to the remainder of the external cleaning apparatus, between a resting position in which the cleaning member is not positioned to cooperate with the at least one support surface, and a raised position in which the cleaning member is positioned to cooperate with the at least one support surface while the rotary brush rotates to remove debris from the rotary brush.

6. The vacuum cleaner system of claim 5, wherein the cleaning member is pivotally mounted to the remainder of the external cleaning apparatus.

7. The vacuum cleaner system of claim 1, wherein the external cleaning apparatus is configured as a hand-held device.

8. The vacuum cleaner system of claim 1, wherein the vacuum cleaner nozzle is operative attached to a vacuum cleaner, and the external cleaning apparatus is configured as a charging stand to selectively hold the vacuum cleaner.

9. The vacuum cleaner system of claim 1, wherein the cleaning member comprises a sheet member having an edge that extends parallel to the longitudinal axis of the rotary brush.

10. The vacuum cleaner system of claim 9, wherein the sheet member is configured to provide resilient contact with the rotary brush when the external cleaning apparatus is in the operative position.

11. The vacuum cleaner system of claim 9, wherein the cleaning member comprises a longitudinal bar holding the sheet member, the longitudinal bar being arranged parallel to the longitudinal axis of the rotary brush.

12. The vacuum cleaner system of claim 9, wherein the cleaning member comprises a flange on which the sheet member is arranged, the flange being located between the sheet member and the rotary brush such that the one or more bristles contact the flange to bend the one or more bristles before the one or more bristles contact the edge.

13. The vacuum cleaner system of claim 1, wherein the at least one radially projecting member is arranged in a helix along the longitudinal axis of the rotary brush.

14. The vacuum cleaner system of claim 1, wherein the at least one radially projecting member comprises radial ribs arranged perpendicular to the longitudinal axis of the rotary brush.

15. The vacuum cleaner system of claim 14, wherein the radial ribs extend from the rotary brush to create multiple pockets along the rotary brush.

16. The vacuum cleaner system of claim 1, wherein the at least one support surface comprises a plurality of segments, each of the segments being arranged at a different radius in relation to the longitudinal axis of the rotary brush.

17. The vacuum cleaner system of claim 16, wherein the radiuses of the segments are gradually changed whereby the segments form a continuous support surface.

18. The vacuum cleaner system of claim 1, comprising a plurality of radially projecting members, each having one or more respective support surfaces.

19. The vacuum cleaner system of claim 1, wherein the cleaning member is configured to be capable of providing contact with at least one segment of at least one support surface.

* * * * *